United States Patent [19]

Wade, Jr. et al.

[11] Patent Number: 4,851,060

[45] Date of Patent: Jul. 25, 1989

[54] MULTILAYER WRAPPED INSULATED MAGNET WIRE

[75] Inventors: Ivan W. Wade, Jr., Fort Wayne, Ind.; John D. Hessler, Payne, Ohio; Harry E. Eloph, Fort Wayne, Ind.

[73] Assignee: Essex Group, Inc., Fort Wayne, Ind.

[21] Appl. No.: 84,367

[22] Filed: Aug. 12, 1987

[51] Int. Cl.[4] ..... H01B 13/08

[52] U.S. Cl. ..... 156/53; 29/860; 174/110 SR; 174/120 R; 428/378

[58] Field of Search ..... 174/110 SR, 120 R, 121 SR, 174/120 SR; 428/378; 156/56, 53; 29/860, 825

[56] References Cited

U.S. PATENT DOCUMENTS

| | | | |
|---|---|---|---|
| 3,033,727 | 5/1962 | Cram et al. | 156/53 X |
| 4,131,714 | 12/1978 | Karkoski et al. | 174/110 SR X |
| 4,271,226 | 6/1981 | Herbreteau | 174/110 SR X |
| 4,624,718 | 11/1986 | Hessler et al. | 156/56 |

FOREIGN PATENT DOCUMENTS

| | | | |
|---|---|---|---|
| 56-16486 | 4/1981 | Japan | 156/53 |
| 60-43607 | 9/1985 | Japan | 174/120 SR |
| 2113454 | 8/1983 | United Kingdom | 174/110 SR |

*Primary Examiner*—Howard N. Goldberg
*Assistant Examiner*—Carl J. Arles
*Attorney, Agent, or Firm*—Harry J. Gwinnell; R. Thomas Payne

[57] ABSTRACT

Magnet wire substrates (1) are described having a layer of polyester tape (2) wrapped thereon, including a layer of spirally wrapped and bonded polyester insulation tape (3) as the outermost layer. The two tape layers are made up of amorphous (4) and crystalline (5) segments unbonded to the wire and bonded to each other to provide the requisite electrical properties and improved physical properties including increased flexibility and ease of strippability. A single multilayer polyester insulation tape can also be used with similar properties and reduced thickness.

2 Claims, 1 Drawing Sheet

MULTILAYER WRAPPED INSULATED MAGNET WIRE

DESCRIPTION

1. Technical Field

The field of art to which this invention pertains is insulated electrical conductors, and specifically insulated magnet wire.

2. Background Art

Insulated magnet wires are primarily used to form coils that create magnetic fields within electrical devices. The majority of these magnet wires have electrical insulation which is bonded to the conductor. This bonded insulation provides toughness to the coated wire but does present other problems.

In use it is necessary to strip the insulation from the wire, for example to connect the wire to the source of electrical energy or to additional electrical components. The added costs and labor to remove this material is tolerated by users because of the desirable toughness imparted to the wires by the bonded coating.

Accordingly, what is needed in this art, is an insulated conductor which provides the required electrical and physical properties, but is readily removable in use.

DISCLOSURE OF INVENTION

An electrically insulated magnet wire substrate is disclosed comprising a metallic conductor with a nonbonded layer of multilayer polyester insulation tape wound thereon. The resulting insulated magnet wire, in addition to having excellent physical and electrical properties, has superior flexibility properties and easily removable insulation.

Another aspect of the invention is an electrically insulated magnet wire substrate comprising a metallic conductor with a plurality of nonbonded layers of multilayer polyester insulation tape wound thereon. The resulting insulated magnet wire, in addition to having excellent physical and electrical properties, has superior flexibility properties and easily removable insulation.

Another aspect of the invention is a method of making the electrically insulated magnet wire substrates by overwrapping the metallic conductor with the polyester insulation tape. The tape is wound around the electrical conductor circumferentially with adjacent turns overlaping or abutting. One side (outer surface) of the multilayer tape contains a layer of polyester in amorphous form and the other side (inner surface) of the tape contains a layer of polyester in crystalline form. The tape is wrapped on the conductor with the crystalline form contacting the conductor. After such wrapping the wire is heated to melt the polyester material also causing the amorphous layers to become crystalline and bond to the crystalline (inner) overwrapped surface.

Another aspect of the invention is a method of making the electrically insulated magnet wire substrates by overwrapping the metallic conductor with the double layer polyester insulation tape. The tape is wound around the electrical conductor circumferentially with adjacent turns overlapping or abutting. Over the first tape layer is spirally wrapped the second multilayer polyester insulation tape. One side (outer surface) of the multilayer tapes contain a layer of polyester in amorphous form and the other side (inner surface) of the tapes contain a layer of polyester in crystalline form. The first tape is wrapped on the conductor with the crystalline form contacting the conductor. The second tape is wrapped on the first tape so that the amorphous form sides of both tapes are in contact. After such wrapping the wire is heated to melt the polyester material also causing the amorphous layers to bond to each other and become crystalline.

Another aspect of the invention is an improved method for connecting wires from the source of electrical energy to an electrical component, or connecting electrical components together, by stripping insulation from a portion of the wire to make the connection followed by making the connection through mechanical or solder means. By utilizing the wires described above the stripping process is greatly reduced in time, expense, and energy.

The foregoing and other features and advantages of the present invention will become more apparent from the following description and accompanying drawing.

BEST MODE FOR CARRYING OUT THE INVENTION

Figure 1:
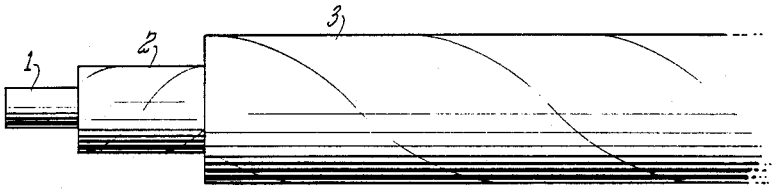
FIG. 1 demonstrates a spirally wrapped wire according to the present invention.

The electrical conductors (1) to be insulated with the tape are conventional conductors in this art and can be either circular, square, or rectangular in cross section, or even hollow (for example for use in waveguides). In addition to solid metal substrates, stranded wires, for example as in cable material, can also be used as the conductor in the present invention.

The wire is generally copper or aluminum and ranges anywhere from 20 mils to 460 mils in diameter, with wires 64 mils to 325 mils in diameter being the most commonly treated wires according to the present invention. Typically for circular cross-section wire 20 gauge (American Wire Gauge) to 1/0 gauge are used, for square cross-section wire 14 gauge to 1/0 gauge, and for retangular cross-section wire, wires 25 to 325 mils thick by 50 mils to 700 mils wide are used. And while the wires are typically bare, i.e. no prior applied insulation material, wires with conventional insulation polymeric coatings (e.g. polyester, polyamide, polyamideimide, etc.—see commonly assigned U.S. Pat. Nos. 4,290,929; 4,374,221; 4,471,022; and 4,476,279, the disclosures of which are incorporated by reference) already applied can also be used according to the present invention.

The polyester can be any electrical grade polyester with one special requirement. The polyester must be multilayer and have an inner surface to go against the metal conductor which is in crystalline form and an outer surface which is in amorphous form. Such material is available from Sterling Paper Company (Seymour, Conn.) as their designation number 809 or 809M. Typically this tape is a polyethylene terephthalate 0.0006 inch to 0.005 inch thick (with 1.2 mil preferred) and 0.25 inch to 1.0 inch wide (with 0.75 inch preferred). As shown in FIG. 2, the crystalline side (5) of the first tape (2) is wrapped against the conductor (1), the amorphous sides (4) of both tapes (2 and 3) are face-to-face, and the crystalline side (5) of the second tape (3) in the outermost layer. The first tape may be wrapped on the conductor and the second tape on the first tape by abutting the respective edges or with a degree of overlap. Typically overlapping of 10% to 75% based on the lower layer is performed, with an approximately 50% overlap preferred. Conventional dual head taping machines such as are available from U.S. Machinery Company may be used for the wrapping operation. Magnaply TM tape packing can also be used. While the polyester tapes can be wrapped in the same directions, typically the polyester tapes are wrapped in opposite directions (note FIG. 1). This cross laying provides better physical properties than laying in the same direction. The amorphous portion of the multilayer tape typically represents 10% to 50% of the overall thickness of the tape and more typically 20% to 40%.

Figure 2:
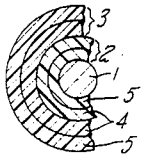
FIG. 2 demonstrates a cross-section of the wire prior to heat treatment.

For that embodiment where only a single multilayer tape is used, the configuration would be as shown in FIG. 1 with the elimination of layer 3.

After applying the polyester layers, the wrapped wire is heated in any conventional heating equipment which can provide fast, controllable heating, such as radiant or air heaters or induction heaters manufactured by Lepel Corporation (New York), or Robotron (Michigan). The heating is controlled so as to affect proper fusing of the polyester layers to each other, causing the amorphous layers to become crystalline, and become bonded to each other while preventing degradation of the film and minimal shrinkage. In the case of two multilayer tapes, the heating would cause the heating to bond to each other. In the case of the single multilayer tape the amorphous layer would bond to the crystalline layer it would be contacting. Typically, for example, for the Sterling type tapes described above, the temperatures of the coated wire reaches 220° F. to 400° F., and preferably 280° F. to 320° F., for a fraction of a second up to about 1.5 minutes.

EXAMPLE

A 5.5 gauge (American Wire Gauge) round copper wire was wrapped using U.S. Machinery Company serving equipment with multilayer polyester film provided by from Sterling Paper Company under the designation 809M. The polyester film was 1.2 mils thick and was overlapped 50%. This same U.S. Machining Company taping equipment was used to apply a second layer of the same tape with the same overlap in a direction opposite that used to wrap the first tape layer with amorphous sides touching as shown in FIG. 2. The thus wrapped wire was passed through an induction heater to fuse the material and provide a smooth coating. The induction heater raised the temperature of the copper wire to 300° F. for up to 1.33 seconds. This was sufficient to fuse the tape layers to each other without drying out or shrinking the tape material. The resulting material had a smooth, slippery coat, which was easily removable.

In addition to the easy removability (for example, using a conventional cutting tool to cut the tape and removing with the fingers) of the insulation of the magnet wire according to the present invention, the wire has excellent physical properties such as toughness, (winding machine toughness), abrasion resistance, a low coefficient of friction (lubricity), etc. In addition it has good electrical properties such as high dielectric strength and high corona resistance. It compares favorably with paper wrapped insulation in electrical properties with improved physical properties. The single multilayer tape wrap also had the advantage of having electrical properties and thickness approaching that of film coated magnet wire with much improved strippability. Compared to such film coated wire this would eliminate the need for highly toxic chemical strippers or brush removers which produce dust and remove the conductor, e.g. copper.

Such wire has utility, for example, in motors in general, in transformer windings, in field armatures for motors, coils in general, generators in general, open motors, etc. The wire is particularly able to withstand winding abuse insertion into motors, and has thermal stability and increased flexibility (tighter radius bending without rupture).

Although the invention has been shown and described with respect to detailed embodiments thereof, it will be understood by those skilled in the art that various changes in form and detail thereof may be made without departing from the spirit and scope of the invention.

We claim:

1. A method of making an electrically insulated magnet wire substrate comprising:

providing a polyester insulation tape formed of a crystalline layer and an amorphous layer bonded to said crystalline layer spirally wrapping in an overlapping fashion at least one layer of said polyester insulation tape on top of a metallic conductor such that in each layer, the amorphous layer is at least partially in contact with the crystalline layer and the crystalline layer is closest to the conductor, subjecting the thus wrapped metallic conductor to sufficient heat to cause the amorphous layer to become crystalline and bond to the crystalline layer at points of contact and fuse the polyester tape to itself but not to the conductor, resulting in a thin insulation layer having high physical and electrical insulating properties, increased flexability, and ease of stripability.

2. A method of making an electrically insulated magnet wire substrate comprising:

spirally wrapping in abutting or overlap fashion a first layer of polyester insulation tape on top of a metallic conductor, wrapping in spiral abutting or overlap fashion on top of the first layer, a second layer of a polyester insulation tape, both said first and second polyester insulation tapes comprising an amorphous polyester layer and a crystalline polyester layer bonded thereto, the first layer of polyester insulation tape being spirally wrapped on the metallic conductor such that the crystalline layer is closest to the conductor, and the second layer of polyester insulation tape being spirally wrapped on the first layer of polyester insulation tape such that the amorphous layer of the second tape contacts the amorphous layer of the first tape, subjecting the thus wrapped metallic conductor to sufficient heat to cause the amorphous layers to become crystalline and fuse the polyester tapes to each other, resulting in an insulation layer having physical and electrical insulating properties, increased flexability, and ease of stripability.

* * * * *